US010000076B2

(12) United States Patent
Ohba

(10) Patent No.: US 10,000,076 B2
(45) Date of Patent: Jun. 19, 2018

(54) DRYING DEVICE AND INKJET PRINTER SYSTEM INCLUDING DRYING DEVICE

(71) Applicant: Tetsuya Ohba, Ibaraki (JP)

(72) Inventor: Tetsuya Ohba, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/864,067

(22) Filed: Jan. 8, 2018

(65) Prior Publication Data

US 2018/0126752 A1 May 10, 2018

Related U.S. Application Data

(63) Continuation of application No. 15/364,643, filed on Nov. 30, 2016, now Pat. No. 9,884,490.

(30) Foreign Application Priority Data

Dec. 15, 2015 (JP) ..... 2015-243720
Oct. 24, 2016 (JP) ..... 2016-208201

(51) Int. Cl.

| | |
|---|---|
| ***B41J 11/00*** | (2006.01) |
| ***B41J 29/377*** | (2006.01) |
| ***B41J 2/01*** | (2006.01) |
| ***B41F 23/04*** | (2006.01) |
| *B41J 15/04* | (2006.01) |
| *F26B 13/18* | (2006.01) |

(52) U.S. Cl.

CPC ..... *B41J 11/002* (2013.01); *B41F 23/0483* (2013.01); *B41J 2/01* (2013.01); *B41J 29/377* (2013.01); *B41J 11/0015* (2013.01); *B41J 15/04* (2013.01); *F26B 13/183* (2013.01); *F26B 13/186* (2013.01)

(58) Field of Classification Search

CPC . B41J 11/002; B41J 2/01; B41J 29/377; B41J 15/04; B41J 11/0015; B41F 23/0483; F26B 13/183; F26B 13/186; F26B 13/18

See application file for complete search history.

(56) References Cited

U.S. PATENT DOCUMENTS 5,333,395 A 8/1994 Bulcsu
6,854,842 B2 * 2/2005 Martin ..... B41J 11/002 347/102

(Continued)

FOREIGN PATENT DOCUMENTS

| | | |
|---|---|---|
| DE | 102010062142 | 5/2012 |
| JP | 11-014258 | 1/1999 |
| JP | 2014-177102 | 9/2014 |

OTHER PUBLICATIONS

European search report dated Jun. 13, 2017 in connection with corresponding European patent application 16201246.2

*Primary Examiner* — Henok Legesse
(74) *Attorney, Agent, or Firm* — Cooper & Dunham LLP

(57) ABSTRACT

A drying device includes a drying section to dry a recording medium; a cooling section to cool the recording medium conveyed from the drying section; and a duct to expel air inside the drying section to outside the drying device. The duct includes a joint section where the air from the drying section meets air from the cooling section meet. The air from the drying section containing moisture and solvent medium is cooled in the duct.

15 Claims, 8 Drawing Sheets

(56) References Cited

U.S. PATENT DOCUMENTS

| | | | | |
|---|---|---|---|---|
| 8,807,736 | B1 * | 8/2014 | Walker | B41J 11/002 347/101 |
| 2009/0056927 | A1 | 3/2009 | Zobel et al. | |
| 2010/0188469 | A1 * | 7/2010 | Ikegami | B41J 3/543 347/102 |
| 2012/0098881 | A1 | 4/2012 | Numata | |
| 2014/0060782 | A1 * | 3/2014 | Ikeda | B41J 11/007 165/104.26 |
| 2016/0046133 | A1 * | 2/2016 | Biglari | B41J 11/002 347/16 |
| 2016/0370758 | A1 | 12/2016 | Ogawa et al. | |

* cited by examiner

DRYING DEVICE AND INKJET PRINTER SYSTEM INCLUDING DRYING DEVICE

CROSS-REFERENCE TO RELATED APPLICATIONS

The present application is a Rule 1.53(b) continuation of application Ser. No. 15/364,643 filed on Nov. 30, 2016, which claims priority pursuant to 35 U.S.C. § 119(a) from Japanese patent application numbers 2015-243720 and 2016-208201, filed on Dec. 15, 2015 and Oct. 24, 2016, respectively, with the Japanese Patent office, the entire disclosure of each of which is incorporated by reference herein.

BACKGROUND

Technical Field

Exemplary embodiments of the present disclosure relate to a drying device and an inkjet printer system including the drying device.

Background Art

In a printer employing a liquid droplet discharge method such as an inkjet printer, an image is fixed onto a recording medium with ink due to evaporation of a solvent component of the ink that permeates the recording medium. In particular, as the permeation of the ink increases, the image is more securely fixed. In recent years, demands for printing on recording media such as coated paper have been increased due to a request for finer image formation.

Permeation of ink into the coated paper with a coated surface is slower than the permeation of ink into a normal sheet, so that the degree of fixation of the image onto the coated paper tends to decrease. Thus, coated paper having better permeability has been developed, but which in turn narrows options for the type of sheets usable, and therefore is not accepted by users.

Further, oily ink and ultra-violet curing ink with lower permeation but higher fixing property are known. Both inks may contain substrates harmful to humans. As a result, special environmental and health precautions are required.

When the image is fixed on the regular and not-luxurious coated paper with aqueous ink, heat to eliminate solvent medium included in the aqueous ink needs to be applied. On the other hand, when using normal paper other than the coated paper, so much heat is not necessary because the aqueous ink effectively permeates the normal paper. When a heater to generate/supply the heat necessarily to be applied to the coated paper is provided, the heat becomes excessive for normal paper. In addition, an extra appliance is needed to supply power to the heater.

As a result, a system in which a drying device to apply heat to the recording medium is disposed downstream of the image forming section of the inkjet printer has been invented. In this system, the inkjet printer retains the capability to heat the coated paper during conveyance to such a degree that the image is not taken by a roller that contacts the image surface on both sides, and the drying device retains capability to heat the image even on other types of sheets for output commercially available in the future.

SUMMARY

In one embodiment of the disclosure, there is provided a drying device including a drying section to dry a recording medium; a cooling section to cool the recording medium conveyed from the drying section: and a duct to expel air inside the drying section to outside the drying device. The duct including a joint section where the air from the drying section meets air from the cooling section meet, and the air from the drying section containing moisture and solvent medium is cooled in the duct.

These and other features and advantages of the present disclosure will become apparent upon consideration of the following description of embodiments of the present disclosure when taken in conjunction with the accompanying drawings.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
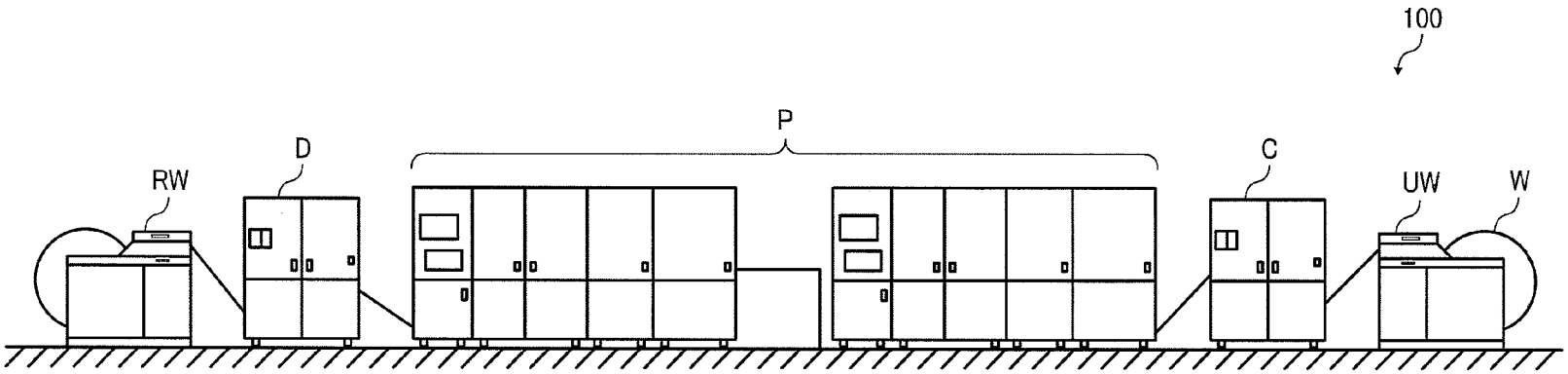
FIG. 1 schematically illustrates an inkjet printer system according a first embodiment of the present disclosure.

Hereinafter, embodiments of the present disclosure will be described with reference to accompanying drawings.

First Embodiment

In the first embodiment, the temperature of moist air having a relatively higher temperature is decreased to 45° C. or less, and generation of condensation is prevented. For this purpose, a path of a duct is bent to lengthen the path, so that the air including a great deal of moisture is gradually cooled when passing though the duct. Further, to increase the cooling efficiency, a contact area between the saturated air and the duct is increased and the duct is formed with materials with a higher heat conductivity. The air containing a solvent medium needs to be handled, and therefore materials for the duct are preferably solvent-resistant materials. In the present disclosure, stainless steel (such as SUS304) is used due to its higher solvent-resistant property. However, stainless steel has a lower heat conductivity than other steels, and has a low radiation performance. Thus, the air sucked in from the drying section and the low-temperature air from the cooling section that cools the recording medium are made to collide, to thereby accelerate reduction of the temperature.

The drying device according to the first embodiment will be described in more detail referring to the drawings, in particular FIGS. 1 to 7.

Figure 2:
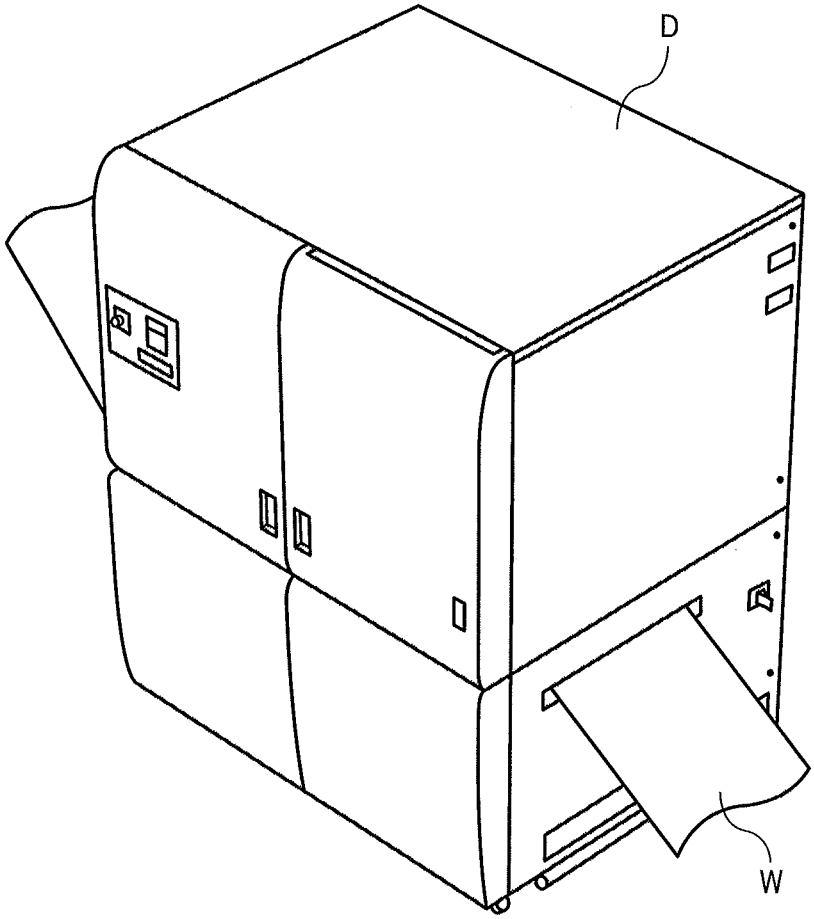
FIG. 2 is a perspective front view of a drying device of FIG. 1.
Figure 3:
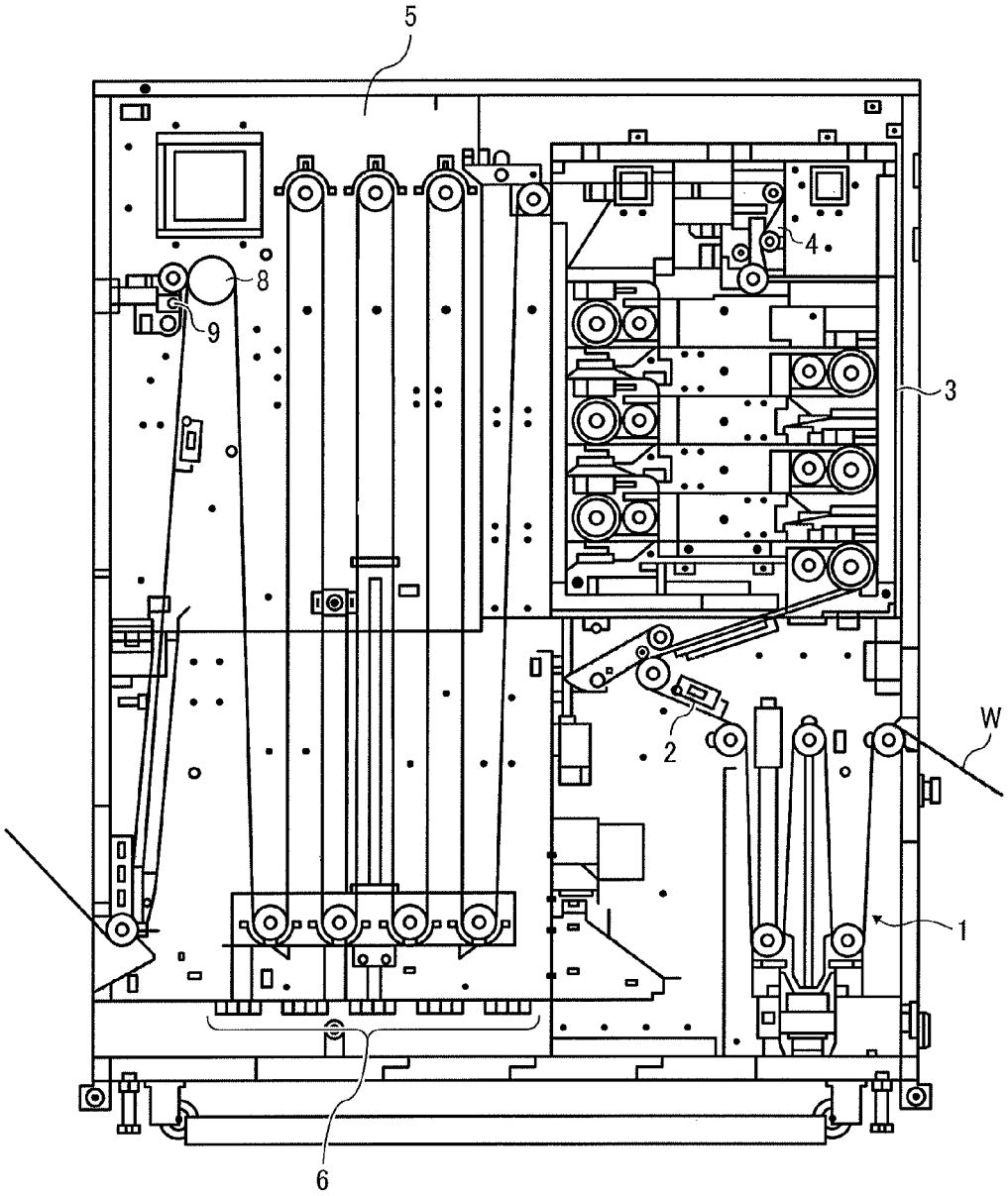
FIG. 3 is a cross-sectional front view of the drying device illustrating an internal structure of the drying device.

FIG. 1 illustrates an inkjet printer system 100, in which the drying device according the present embodiment is incorporated in combination. FIG. 2 is a perspective front view of the drying device illustrating an external view of the drying device. FIG. 3 is a cross-sectional front view of the drying device illustrating an internal structure of the drying device.

A continuous recording medium W rolled into the shape of a roller is sent from an unwinder UW and a coating device C pre-treats the recording medium W with a solvent coating. Then, the inkjet printer P prints letters or images on the recording medium W, and the recording medium W is sent to a drying device D. In the drying device D, the recording medium W after having been subjected to heating and cooling processes is rolled up by a re-winder RW to complete a single printing process.

The drying device D includes a dancer roller unit 1 including two driven rollers movable in the vertical direction. The dancer roller unit 1 applies its own weight to the recording medium W conveyed to the drying device D, so that the recording medium W is pulled with tension by the dancer roller unit 1 downward.

Next, the recording medium W passes through a sensor 2 that senses the recording medium W and the drying device D whether or not the recording medium W is at an input part. Then, another sensor detects the temperature of the recording medium W. The recording medium W is heated while passing through a drying section 3 to accelerate fixing of the image onto the recording medium W. The drying section 3 includes a built-in heater and includes 6 heat rollers each having a surface controlled at a predetermined temperature. The heat roller is disposed to rotate following the move of the recording medium W.

A cutter unit 4 including a cutter is disposed to prevent the internal structure inside the drying device from being damaged due to an excess tension applied to the recording medium W caused by malfunction and runaway of the drying device. The cutter unit 4 cuts the recording medium W depending on the tension of the recording medium W and an increasing speed of the tension.

The recording medium W is conveyed to a cooling section 5 that cools the recording medium W after having passed the above sections. The cooling section 5 includes a plurality of driven rollers and defines a path in which the recording medium W is moved in the vertical direction. The cooling section 5 includes a plurality of cooling fans 6 each to cool the recording medium W by blowing air from the bottom upward. In addition, air is taken in from an intake port 7. The air sent by the cooling fans 6 hits and flows along the recording medium W and is sucked out or expelled via the intake port 7. When the recording medium W passes through the cooling section 5, cooling of the recording medium W is complete. Length of the cooling path, and amount and temperature of the cooling air, are determined based on the heat applied in the drying section 3 and the thermal capacity of the recording medium W, and are determined in the design of the device.

After the cooling section 5, provided are an outfield roller 8 and a pressure roller 9 that pinches the recording medium W together with the outfield roller 8. The outfield roller 8 is connected to a drive source such as a motor, and minutely adjusts a speed of the recording medium W depending on the state of the dancer roller unit 1 or a position in the vertical direction. The outfield roller 8 and the pressure roller 9 can convey the recording medium W following rotation of the drive source.

Figure 4:
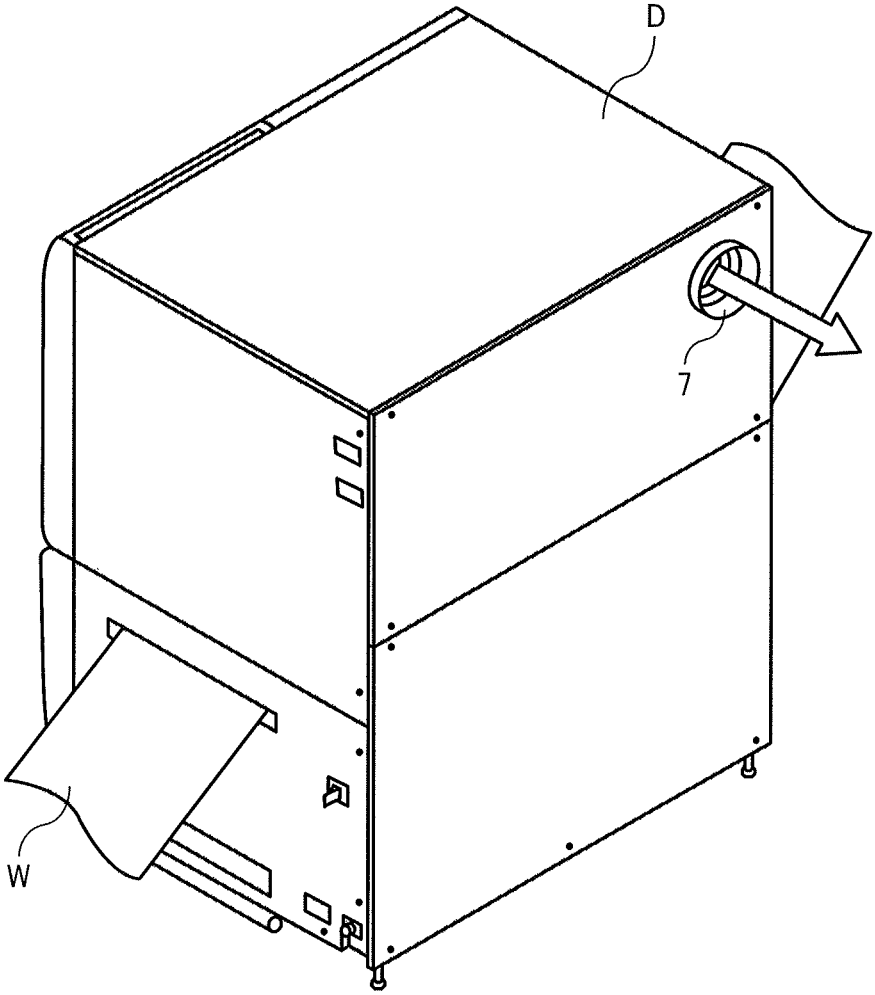
FIG. 4 is a perspective rear view of the drying device illustrating an external view of the drying device.

FIG. 4 is a perspective rear view of the drying device illustrating an external view of the drying device. The intake port 7 is disposed at an upper portion seen from a rear side of the drying device D. As illustrated in FIG. 4, the air is sucked in in the direction of the arrow. The intake port 7 is connected to another hose or the like, other than the drying device D.

Figure 5:
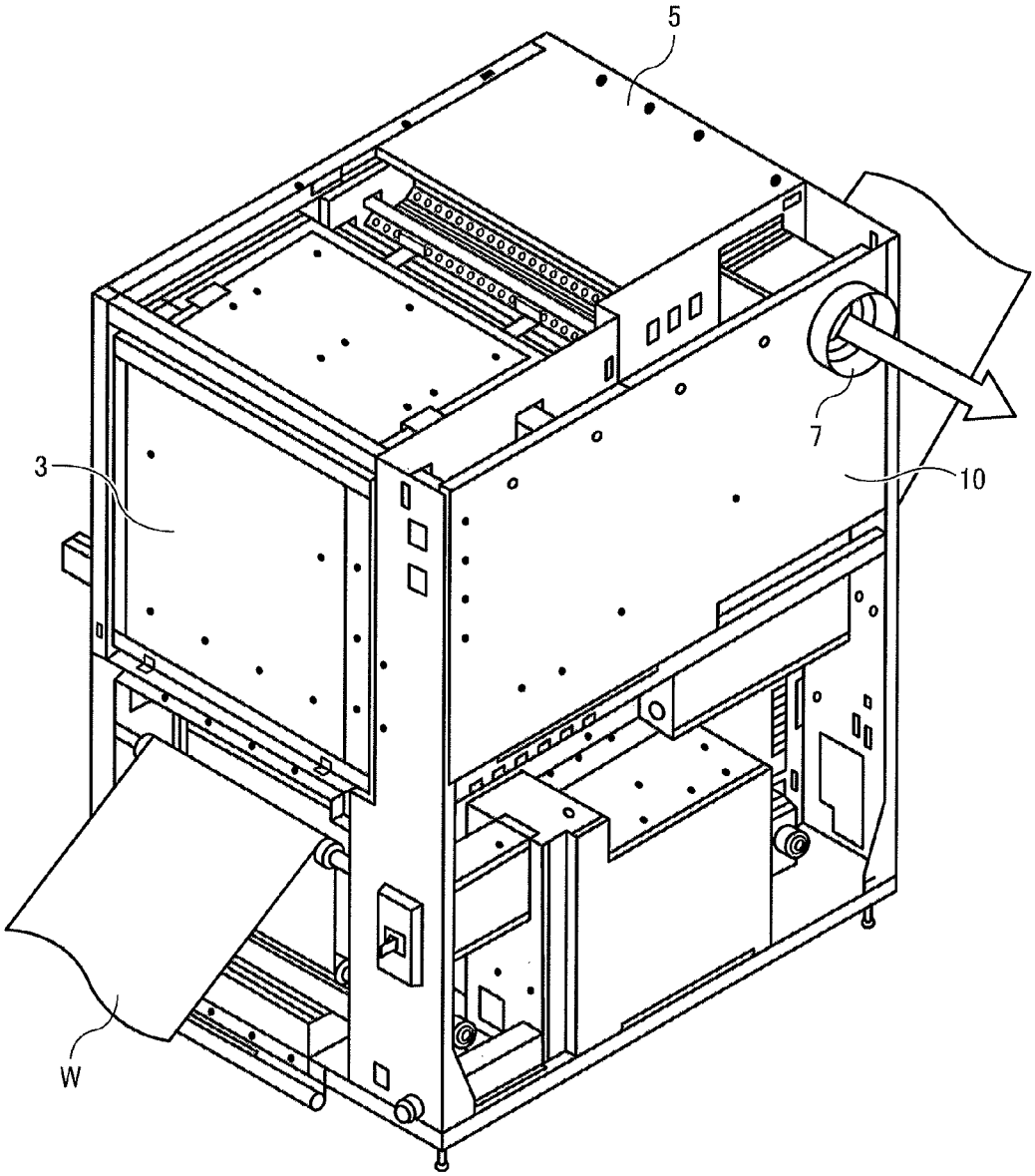
FIG. 5 is a perspective rear view of the drying device illustrating a state in which an external cover is removed.

FIG. 5 is a perspective rear view of the drying device D illustrating a state in which an external cover is removed. A duct 10 introduces air into the cooling section 5 and the drying section 3 to the intake port 7, and the air inside the drying device is exhausted by external sucking equipment in in the direction of the arrow.

Figure 6:
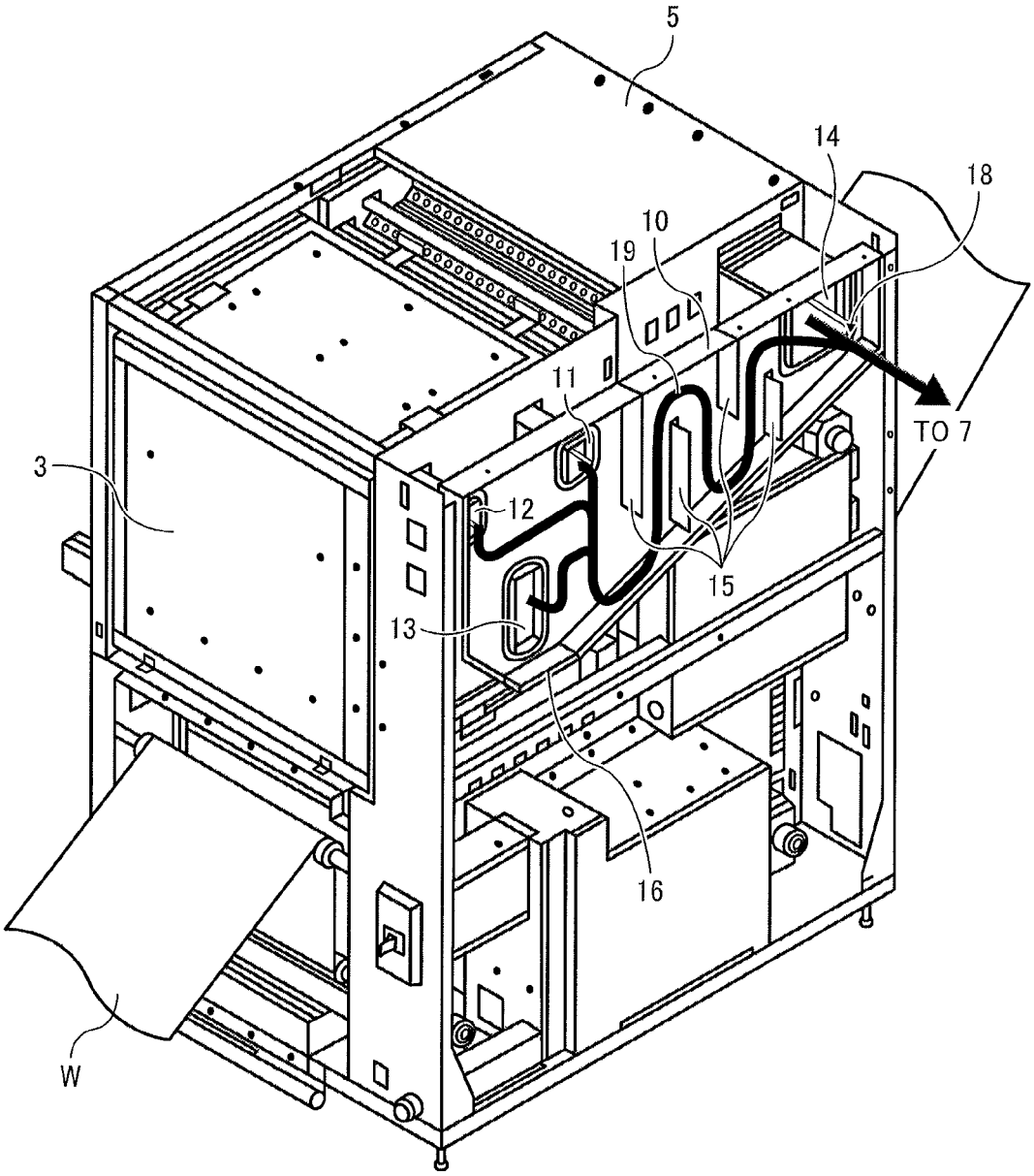
FIG. 6 is a perspective rear view of the drying device without the external cover illustrating an internal structure of an aspiration duct of the drying device.

FIG. 6 is a perspective rear view of the drying device D without an external cover illustrating an internal structure of a suction duct. The drying section 3 and the duct are connected at portions 11 to 13, so that the air inside the drying section 3 is sucked inside the duct 10. The interior of the duct 10 is partitioned by a plurality of partition plates 15 in a cascaded manner, to thereby form a serpentine path. The sucked air passes along the path indicated by the arrow. Such a serpentine path 19 provides a longer cooling time than a straight path would do.

Figure 7:
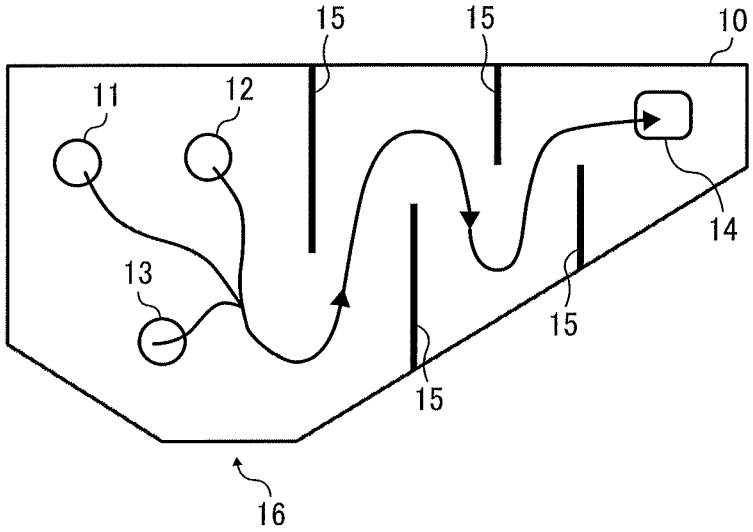
FIG. 7 illustrates a general structure of the drying device and a flow of air inside the duct according to a first embodiment of the present disclosure.

FIG. 7 illustrates a general structure of the drying device according to the first embodiment of the present disclosure and a general flow of the air inside the duct 10. In the present embodiment, as described above, the duct 10 is curved to extend the path. Further, the area around the duct 10 is partitioned by the plurality of partition plates 15 in a cascaded manner.

With the present structure, the condensed liquid inside the duct 10 is concentrated and collected in a collection section 16 due to the weight and is collected therein, because the collection section 16 disposed in the bottom of the duct 10 has a narrowed shape. The cooling section 5 and the duct 10 are connected via an opening 14. The air from the drying section 3 joins in the vicinity of the opening 14 (at a joint section 18) inside the duct 10, and is cooled. The air joined in the vicinity of the opening 14 is sucked and exhausted in the direction of the arrow as illustrated in FIG. 7.

Second Embodiment

Figure 8:
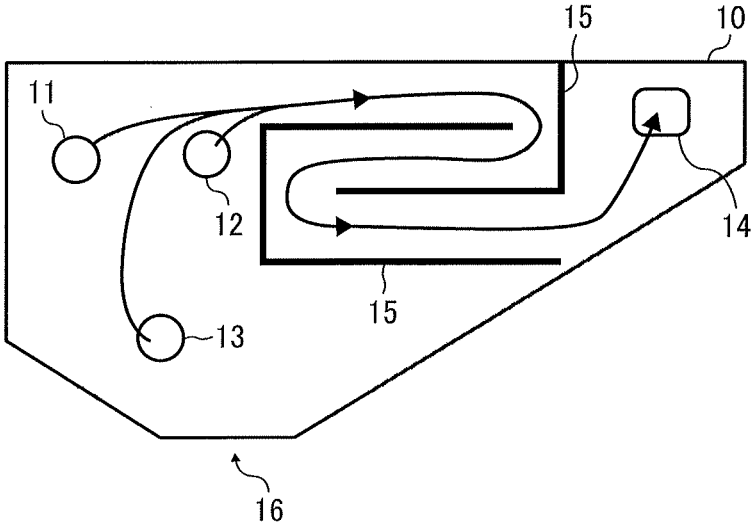
FIG. 8 illustrates a general structure of the drying device and a general flow of air inside the duct according to a second embodiment of the present disclosure.

FIG. 8 illustrates a general structure of the drying device D according to the second embodiment of the present disclosure and a general flow of the air inside the duct 10. In the second embodiment, positions of the partition plates 15 are changed to a transverse direction and the path is bent as illustrated in FIG. 8. The area inside the duct 10 is partitioned by the partition plates 15 and the air sucked from the drying section 3 passes the route indicated by arrow in FIG. 8 and joins with the other sucked airflows and reaches the intake port 7. Specifically, compared to the structure according to the first embodiment in which the air flows while wobbling in the vertical direction, the air flows in the transverse direction in the second embodiment.

Third Embodiment

Figure 9A:
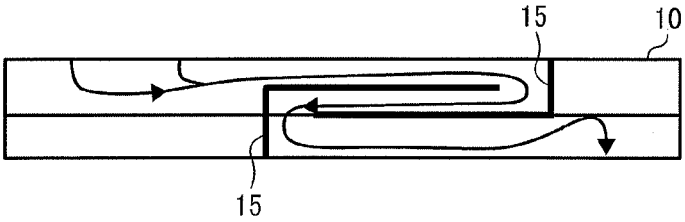
FIGS. 9A and 9B illustrate side and top views, respectively, of a general structure of the drying device and a general flow of air inside the duct according to a third embodiment of the present disclosure.
Figure 9B:
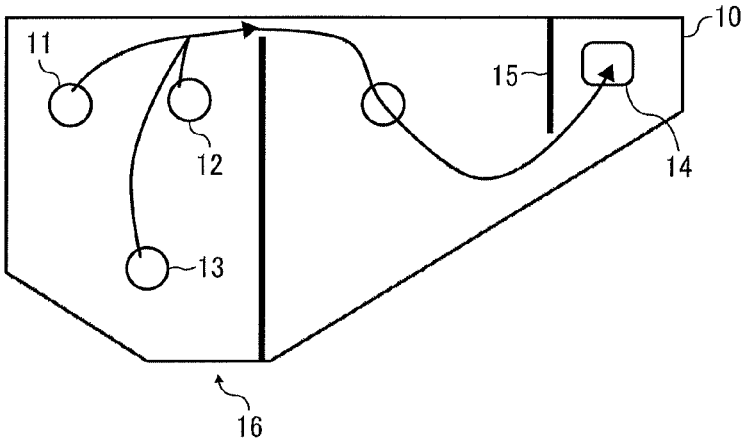

FIGS. 9A and 9B illustrate side and top views, respectively, of a general structure of the drying device according to the third embodiment of the present disclosure and a general flow of the air inside the duct 10. In the third embodiment, partition by the partition plates 15 is made in the depth direction, not in the transverse direction, and the path is configured to be bent. The area inside the duct 10 is partitioned by the partition plates 15, and the air sucked from the drying section 3 passes through the path as indicated by arrow in FIGS. 9A and 9B, joins the sucked airflow at the opening 14, and reaches the intake port 7. In the structures as illustrated in FIGS. 7 and 8, the airflow flows wobbling vertically or laterally. In the third embodiment, the air takes a path flowing in the depth direction as illustrated in FIG. 9A.

Fourth Embodiment

Figure 10:
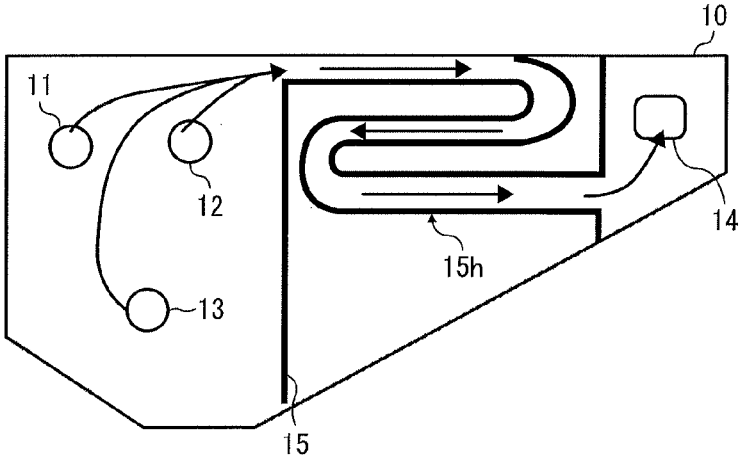
FIG. 10 illustrates a general structure of the drying device and a flow of air inside the duct according to a fourth embodiment of the present disclosure.

FIG. 10 illustrates a general structure of the drying device according to the fourth embodiment of the present disclosure and a general flow of the air inside the duct 10. In the fourth embodiment, instead of the partition plates, the airflow path is curved using a tube. In each of the above embodiments, the area inside the duct 10 is partitioned by the partition plates 15 and the air sucked from the drying section 3 passes the path as indicated by arrow in FIG. 10, joins other sucked air at the opening 14, and reaches the intake port 7. Accordingly, although separation of the airflow has been performed by the partition plates 15, in the present embodiment, the path is partitioned by a tube 15*h* such as a hose or a tube.

As described above, according to the embodiments of the present disclosure, provided is a drying device that can absorb heat in the air such that the moisture and the air containing the solvent medium in ink do not cause dew formation even discharged outside the device, and after the moisture in the air and the solvent medium is concentrated in a liquid shape, is collected in the form of the liquid, and the air is discharged outside. Also, an inkjet printer system including the drying device is provided.

According to the drying device and the inkjet printer system including the drying device according to at least one embodiment of the present disclosure, water and solvent are collected from the air containing a great deal of moisture generated in the drying section, and condensation generation due to the concentration outside the drying device can be prevented.

Additional modifications and variations of the present disclosure are possible in light of the above teachings. It is therefore to be understood that, within the scope of the appended claims, the disclosure may be practiced other than as specifically described herein.

What is claimed is:

1. A heating device comprising:
- a heating section to heat a recording medium;
- a cooling section to cool the recording medium conveyed from the heating section; and
- a duct to guide air from inside the heating section to outside the heating device, the duct including:
  - a first inflow portion through which the air in the heating section flows into the duct; and
  - a second inflow portion through which the air in the cooling section flows into the duct,
- wherein a width of the duct in a height direction of the heating device decreases from the first inflow portion toward the second inflow portion.

2. The heating device according to claim 1, further comprising an intake port to expel the air in the duct to outside the heating device,
- wherein the width of the duct in the height direction of the heating device decreases from the first inflow portion toward the intake port.

3. The heating device according to claim 1, further comprising a collection unit disposed in the duct to collect a condensed liquid in the duct,
- wherein the collection unit is disposed at a position at which the width of the duct in the height direction of the heating device is largest in the duct.

4. The heating device according to claim 3, further comprising:
- an inclined portion disposed at a bottom of the duct and inclined downwardly toward the collection unit; and
- a serpentine path disposed above the inclined portion inside the duct.

5. An inkjet printer system comprising:
- an inkjet printer to form an image on a recording medium; and
- the heating device according to claim 1 to heat the recording medium.

6. A heating-and-cooling device comprising:
- a heating section to heat a recording medium;
- a cooling section to cool the recording medium conveyed from the heating section; and
- a duct to guide air inside the heating section to outside the heating-and-cooling device, the duct including:
  - a first inflow portion through which the air in the heating section flows into the duct; and
  - a second inflow portion through which the air in the cooling section flows into the duct,
- wherein a width of the duct in a height direction of the heating-and-cooling device decreases from the first inflow portion toward the second inflow portion.

7. The heating-and-cooling device according to claim 6, further comprising
- an intake port to expel the air in the duct to outside the heating-and-cooling device,
- wherein the width of the duct in the height direction of the heating-and-cooling device decreases from the first inflow portion toward the intake port.

8. The heating-and-cooling device according to claim 6, further comprising
- a collection unit disposed in the duct to collect a condensed liquid in the duct,
- wherein the collection unit is disposed at a position at which the width of the duct in the height direction of the heating-and-cooling device is largest in the duct.

9. The heating-and-cooling device according to claim 8, further comprising:
- an inclined portion disposed at a bottom of the duct and inclined downwardly toward the collection unit; and
- a serpentine path disposed above the inclined portion inside the duct.

10. An inkjet printer system comprising:
- an inkjet printer to form an image on a recording medium; and
- the heating-and-cooling device according to claim 6 to heat and cool the recording medium.

11. A drying device comprising:
- a heating section to heat a recording medium;
- a cooling section to cool the recording medium conveyed from the heating section; and
- a duct to guide air inside the heating section to outside the drying device, the duct including:
  - a first inflow portion through which the air in the heating section flows into the duct; and a second inflow portion through which the air in the cooling section flows into the duct, wherein a width of the duct in a height direction of the drying device decreases from the first inflow portion toward the second inflow portion.

12. The drying device according to claim 11, further comprising an intake port to expel the air in the duct to outside the drying device, wherein the width of the duct in the height direction of the drying device decreases from the first inflow portion toward the intake port.

13. The drying device according to claim 11, further comprising a collection unit disposed in the duct to collect a condensed liquid in the duct, wherein the collection unit is disposed at a position at which the width of the duct in the height direction of the drying device is largest in the duct.

14. The drying device according to claim 13, further comprising:

an inclined portion disposed at a bottom of the duct and inclined downwardly toward the collection unit; and a serpentine path disposed above the inclined portion inside the duct.

15. An inkjet printer system comprising:

an inkjet printer to form an image on a recording medium; and the drying device according to claim 11 to dry the recording medium.

* * * * *